United States Patent [19]

Townsend

[11] 4,088,548

[45] May 9, 1978

[54] ELECTROLYTIC METHOD AND APPARATUS FOR REFRACTORY METALS USING A HOLLOW CARBON ELECTRODE

[76] Inventor: Douglas W. Townsend, 35 Front St., Mississauga Ontario, Canada

[21] Appl. No.: 708,739

[22] Filed: Jul. 26, 1976

Related U.S. Application Data

[60] Continuation-in-part of Ser. No. 656,871, Feb. 10, 1976, and a continuation-in-part of Ser. No. 360,467, Mar. 15, 1973, Pat. No. 3,979,267, said Ser. No. 656,871, is a division of Ser. No. 360,467.

[51] Int. Cl.[2] ..... C25D 3/66

[52] U.S. Cl. ..... 204/39; 204/68; 204/69

[58] Field of Search ..... 204/39, 71, 273, 277, 204/64, 247

[56] References Cited

U.S. PATENT DOCUMENTS

| | | | |
|---|---|---|---|
| 2,752,303 | 6/1956 | Cooper | 204/71 |
| 3,669,852 | 6/1972 | Winters | 204/277 |
| 3,979,267 | 9/1976 | Townsend | 204/39 |

*Primary Examiner*—John H. Mack
*Assistant Examiner*—H. A. Feeley
*Attorney, Agent, or Firm*—Gilbert L. Wells

[57] ABSTRACT

The method and apparatus for removing substantially all oxygen from an electrolytic melt of a fluoride of alkali metal fluorides or alkalide earth metal fluorides is improved by using a hollow carbon anode. The melt is maintained above its melting temperature, the hollow carbon anode is immersed in the melt, an ambient pressure is maintained on the melt which is less than one-third the pressure within the hollow anode and a positive potential is maintained on the anode relative to the melt which is sufficient to remove oxygen but less than the potential at which anode effect occurs.

15 Claims, 3 Drawing Figures

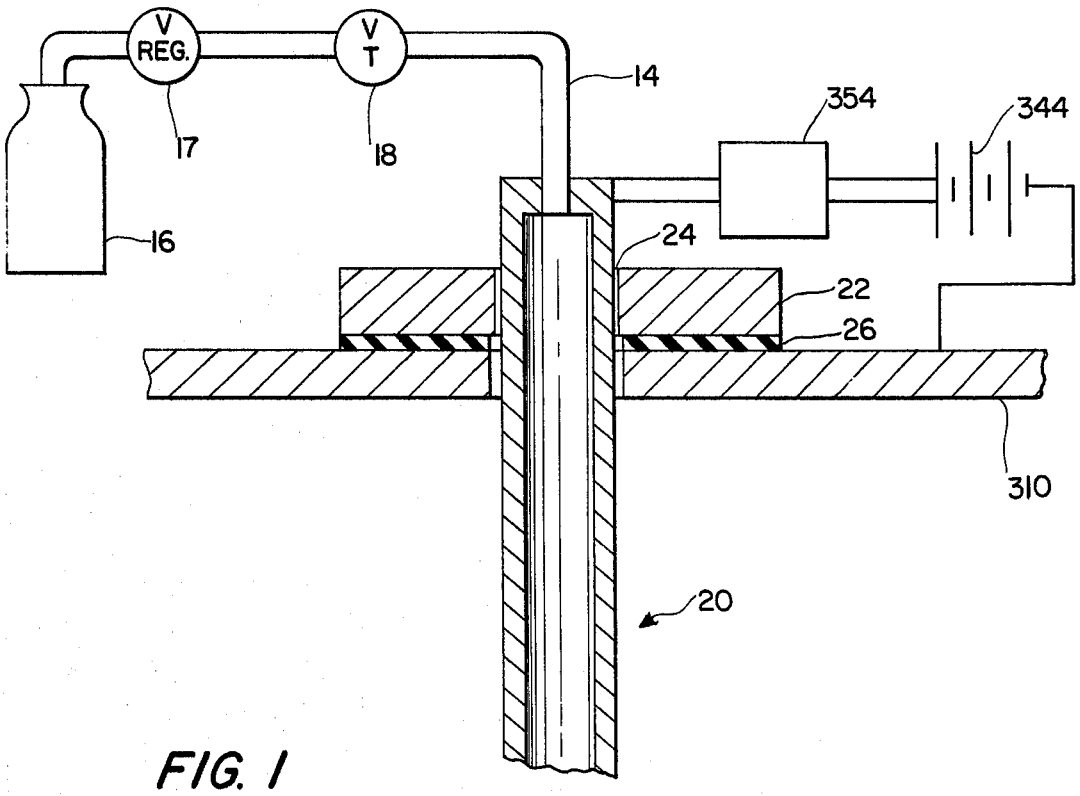
FIG. 1
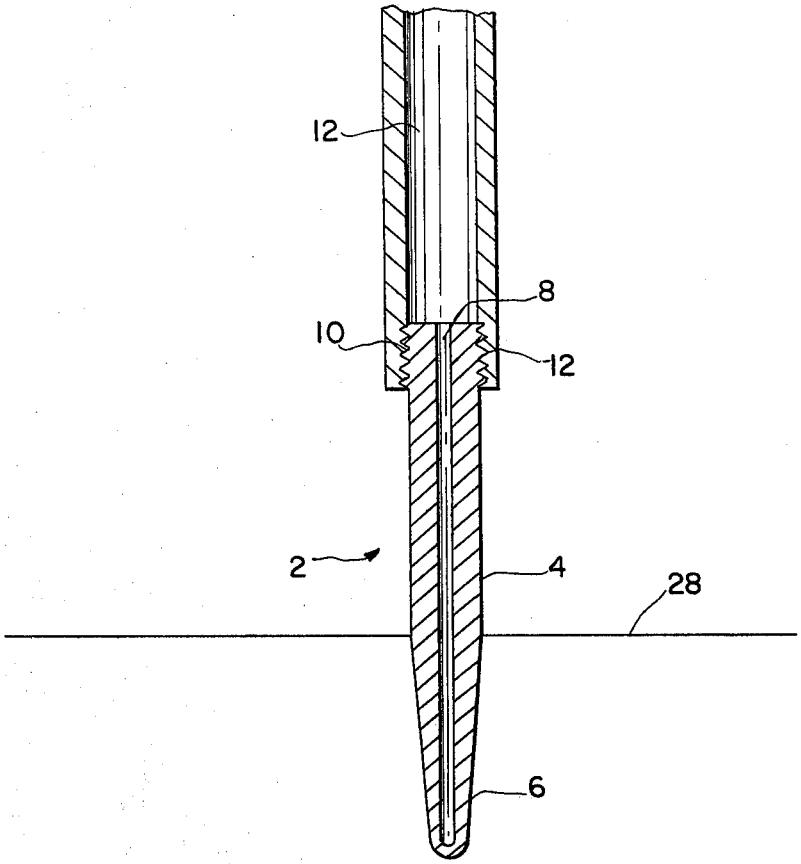

ELECTROLYTIC METHOD AND APPARATUS FOR REFRACTORY METALS USING A HOLLOW CARBON ELECTRODE

CROSS REFERENCES TO RELATED APPLICATIONS

The present application is a Continuation-In-Part of Application Ser. No. 360,467, filed Mar. 15, 1973, now U.S. Pat. 3,979,267 and of Application Ser. No. 656,871, filed Feb. 10, 1976. Application Ser. No. 656,871 is a Division of Application Ser. No. 360,467.

U.S. Pat. 3,979,267 defines the method of removing substantially all oxygen from an electrolytic melt of a fluoride of alkali metal fluorides or alkaline earth metal fluorides by maintaining the melt above its melting temperature, maintaining the ambient pressure of the melt at less than one-third atmosphere, providing a carbon anode in the melt, and maintaining a positive potential of about 1 to 3 volts on the anode relative to the melt sufficient to remove oxygen but less than the potential at which anode effect occurs.

Application Ser. No. 656,871 is drawn to the apparatus for carrying out the method of Application Ser. No. 360,467.

BACKGROUND OF THE INVENTION

The field of the invention is electrolytic coating processes from a fused bath and apparatus therefore. The invention is particularly concerned with using a porous, hollow carbon anode in a fluoride melt in order to reduce the concentration of oxygen and thereby obtain improved niobium coatings.

The state of the art of electrolytic deposition from a fluoride melt may be ascertained by reference to copending U.S. Pat. 3,979,267, U.S. Pat. No. 3,444,058 of Mellors et al, and the Publication of Mellors et al in the Journal of the Electrochemical Society, Vol. 112, No. 3, Mar. 1965.

The state of the art of the carbon electrodes useful in the present invention (modified by drilling a hole lengthwise therein) may be ascertained by reference to the 1970 Canadian Catalog of Fisher Scientific Co., Limited, p. 172, particularly National AGKSP graphite electrodes, and the book "Ceramics for Advanced Technologies," by J. E. Hove and W. C. Riley (1965), published by John Wiley & Sons, pp. 14–25, particularly p. 21. The density of the National AGKSP electrodes is about 1.58 g/cm$^3$. The material is composed of tiny crystallites of graphite, as shown on page 21 of the Hove and Riley book, and each crystallite is about 2.2 g/cm$^3$. From Table 2.2 on page 22 of Hove and Riley, it can be determined that the graphite is composed of fine grained stock with a maximum particle size of the order of 0.015 inches.

SUMMARY OF THE INVENTION

The method and apparatus of copending U.S. Pat. No. 3,979,267 and application Ser. No. 656,871 are improved by using a carbon or graphite electrode having a hole drilled along the electrode axis and by connecting the hollowed out electrode to a source of inert gas at a controlled pressure. The inert gas is expelled through the pores of the carbon or graphite electrode and causes stirring of the fluoride melt.

BRIEF DESCRIPTION OF THE DRAWINGS

The present invention may best be described by reference to the drawings appended hereto, wherein:

FIG. 1 is a side view partially in cross-section, showing the carbon electrode of the present invention as modified for use in the electrolytic cell of FIG. 3 of U.S. Pat. No. 3,979,267;

DESCRIPTION OF THE PREFERRED EMBODIMENTS

Figure 2:
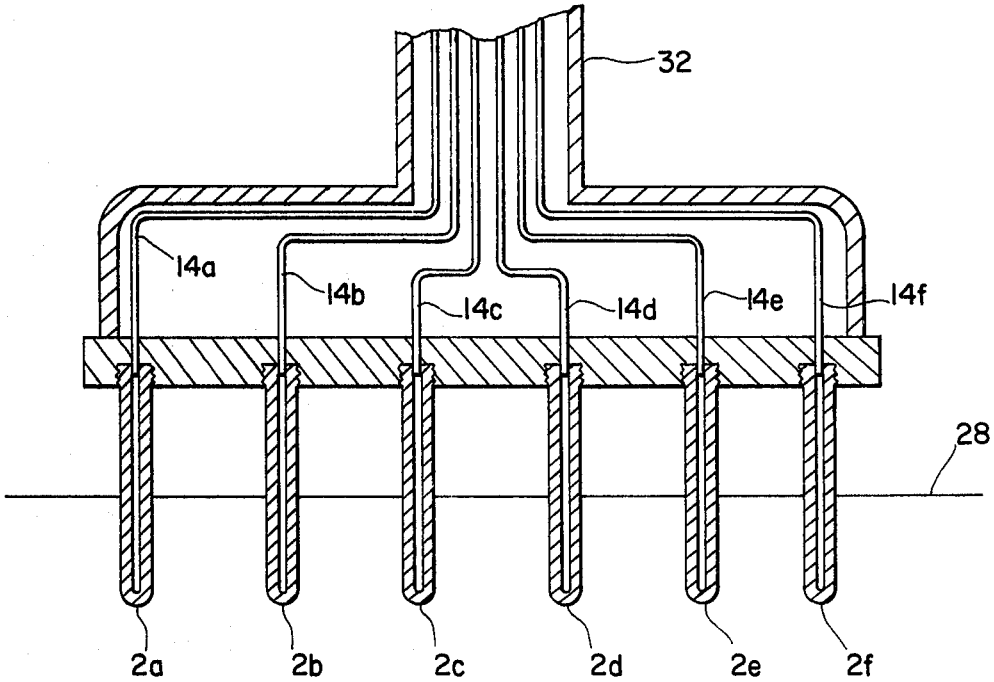
FIG. 2 is a side view showing further embodiments of multiple electrodes useful in the present invention.

With particular reference to FIG. 1, the carbon electrode 2 is shown having a straight body portion 4 with a tapered portion 6 and a lateral hole 8 drilled through the middle thereof. The upper portion of the electrode is threaded at 10 for threadedly connecting threads 12 of electrically conductive metal extension tube 20. The metal extension tube 20 has a hollow center 12 for conducting an inert gas such as argon and is connected at the top by gas line 14 which leads to a pressurized gas container 16. A constant pressure valve 17 and a throttle valve 18 are connected in series along the line 14 between the gas supply 16 and the extension tube 20. The head of extension tube 20 is electrically connected to anode control means 354 and direct current source 344 for maintaining the anode 2 at a positive potential relative to the crucible as is done in FIG. 3 of U.S. Pat. No. 3,979,267. The extension tube 20 is secured to the top 310 of the crucible of U.S. Pat. No. 3,979,267 by metal cap 22 having vacuum seal 24 between the cap bore and the smooth wall of the extension tube and electrical insulation 26 such as thermal resistant rubber between the cap and the top 310.

The anode 2 is immersed in the fluoride melt to the level 28.

In FIG. 2 the support plate 30 has threaded therein a plurality of anodes 2*a* – 2*f*, as in FIG. 1. Each of the gas supply lines 14*a* – 14*f* is controlled by a throttle valve from a common constant pressure manifold connected to a pressurized gas container. The gas is carried to the individual anodes by separate metal tubes 14*a* – 14*f* that pass through a common support rod 32 that makes the vacuum seal. In another embodiment, a short metal extension tube is used between the support plate 30 and the anodes 2*a* – 2*f* as in FIG. 1.

Figure 3:
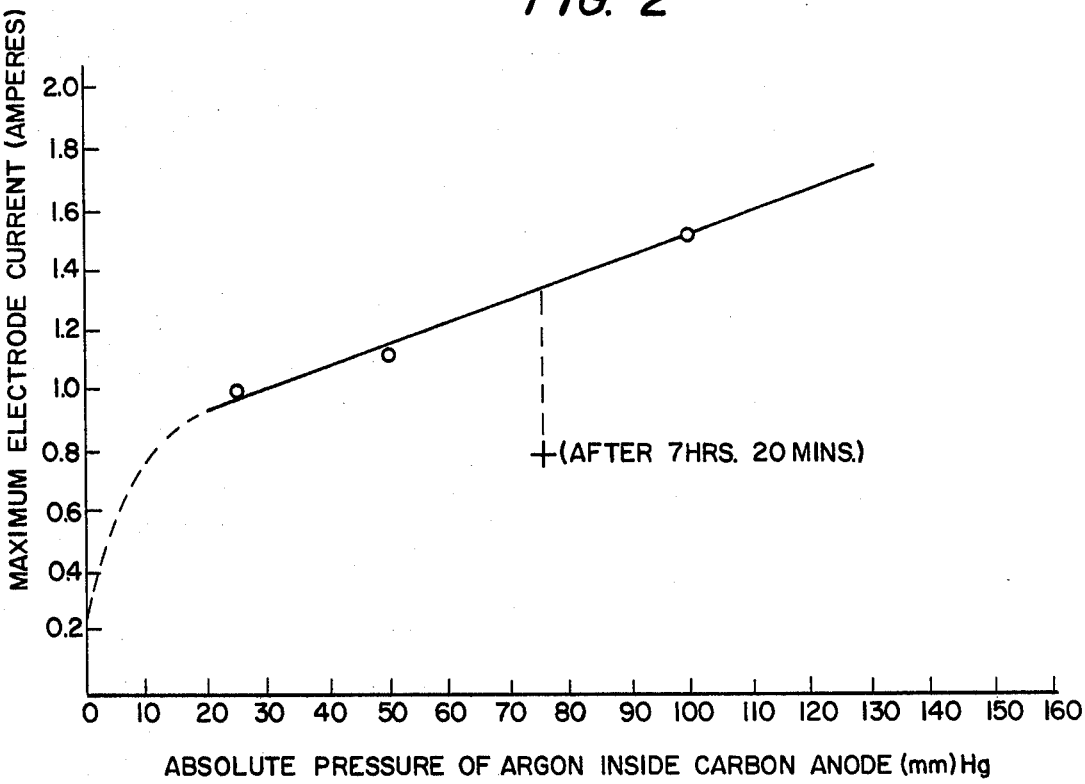
FIG. 3 is a graphical representation showing a plot of the absolute pressure of argon inside the carbon electrode of FIG. 1 versus the electrode current in amperes at 2.1 volts.

FIG. 3 is a plot of the maximum electrode current in amperes at 2.1 volts against the absolute pressure of argon inside the anode 2 of FIG. 1 in mm of mercury.

The onset of stirring resulting from the argon gas forced through the carbon anode 2 occurs between 0 and 25 mm of mercury, and turbulent conditions are immediately created surrounding the anode. The amount of current passed is then proportional to the differential pressure across the anode wall. The amount of bubbling and presumably the gas flow rate is also proportional to the pressure across the anode wall thickness. Therefore, the current flow is proportional to the stirring rate as shown by the plot of pressure versus current in FIG. 3.

After seven hours and 20 minutes with the pressure maintained at 72 mm of Hg, the current dropped to 0.8 amperes as indicated in FIG. 3. The current did not fall further during the next sixteen hours. This is postulated to be the residual current of the oxygen free system.

The present invention is based upon the concept that the rate of electrochemical discharge of oxygen ions is increased as a result of the stirring imparted by large volumes of gas generated under vacuum conditions in molten fluoride electrolytic baths. To enhance this effect, the applicant drills holes along the axes of the electrodes and introduces an inert gas such as helium, argon, neon, krypton, xenon, radon, carbon monoxide or carbon dioxide. The carbon electrode materials, which include graphite, are slightly porous. The inert gas diffuses through the electrode due to the pressure gradient established by evacuating the crucible. In passing through the electrode, the inert gas expands several hundred times in volume so that a relatively small mass of gas generates a very large bubble volume when expanded into the hot melt which is kept at a low absolute pressure by means of vacuum pumps.

The following specific examples illustrate the preparation of an electrode of the present invention and one embodiment of carrying out the process of the present invention.

EXAMPLE 1

A hollow carbon or graphite anode is constructed by drilling (in a lathe) a small blind hole along the axis of a cylindrical rod. A 1/16 inch hole is sufficient as the amount of gas used is very small. The hole should not come closer than one radius to the bottom of the rod as all surfaces are attacked during oxygen removal from a molten salt. The top of the rod is threaded with a tapered thread (pipe thread) to provide a leak free joint with a metal tube that is connected to a supply of argon. It has been found satisfactory to put the male thread on the carbon rod and the female thread on the end of the metal tube. Breakage of the carbon or graphite rod would more easily occur if these threads are reversed. The anode may be tapered beginning an inch or so below the surface of the salt. This can provide a more even reduction in the cross section of the anode. That part of the anode for a distance of about 2 cm below the surface of the salt is often preferably attacked. A round cross section for the anode is preferred as carbon or graphite is easily obtained in this shape and is easily machined to the required shape to be used. Rectangular or other shapes can of course be used but are more difficult to machine and are unlikely to be evenly attacked by the salt as the distance from the hole to the surface must vary. This causes variations in the amount of inert gas passing through various areas of the electrode. The local stirring rate is variable as is the rate of attack of the anode.

EXAMPLE 2

In a molten fluoride solution containing 4 kilograms of a eutectic mixture of sodium, potassium and lithium fluoride plus about 15 weight percent of tantalum fluoride $TaF_5$ at 675° C, a graphite anode was polarized to a potential of 2.1 volts with respect to a tantalum reference electrode. This voltage gives the maximum current density. Both the inside and the outside of the graphite anode are evacuated to a pressure of 0.3 mm of Hg. A maximum current of only 0.1 amperes flowed to the anode. Very slow bubbling of gas could be observed at the electrode. The hole along the axis of the round anode was then connected to an argon supply so that the absolute pressure inside the electrode could be controlled by means of a diaphragm valve opposed to atmospheric pressure. The absolute pressure inside the anode was then increased in stages and the electrical current-voltage curve shown by FIG. 3 was obtained. Considerable bubbling was observed when the absolute pressure in the anode exceeded 25 mm of Hg. At a pressure of 165 mm of Hg bubbling at the anode was as great as is usually observed at an ordinary graphite anode when it is drawing about 4 amperes. This would be possible only if the salt solution contained much more oxygen than the one just described. When the electrical potential to the hollow anode was interrupted while the inside was pressurized, the bubbling continued at a considerable rate. The absolute pressure above the surface of the salt remained at 0.3 mm of Hg throughout the example.

I claim:

1. For removing substantially all oxygen from an electrolytic melt consisting essentially of oxygen ions and at least one fluoride selected from the group consisting of alkali metal fluorides and alkaline earth metal fluorides, the process comprising the steps of:

(a) maintaining said melt above its melting temperature;

(b) providing a porous and hollow anode in said melt consisting essentially of carbon;

(c) maintaining the ambient pressure on said melt at less than one-third that within said anode and introducing an inert gas into the interior of said anode with a pressure gradient between the inside and outside of the anode sufficient to generate bubbles; and (d) maintaining a positive potential on said anode relative to said melt sufficient to remove oxygen but less than the potential at which anode effect occurs.

2. The process of claim 1, wherein said ambient pressure over said melt is less than 700 mm Hg.

3. The process of claim 1, wherein said ambient pressure over said melt is between about 0.001 mm of Hg and 700 Hg.

4. The process of claim 1, wherein said positive potential is between about 1 to 3 volts.

5. The process of claim 1, wherein said inert gas inside said anode is at a pressure of greater than about 25 mm Hg.

6. The process of claim 5, wherein said inert gas is selected from the group consisting of helium, argon, neon, krypton, xenon, radon, carbon monoxide and carbon dioxide.

7. The process of claim 1, wherein said melt consists of at least one fluoride from the group of alkali metal fluorides.

8. The process of claim 1, wherein:

(e) said melt includes a substantial concentration of cations of metals from the group consisting of the metals of Groups IV-B, V-B, and VI-B of the Periodic Table, with the further steps of:

(f) providing in said melt a cathode; and (g) applying to said cathode a potential relative to said melt sufficient to cause to be deposited on said cathode a metal from the group consisting of (I) metals selected from the groups IV-B, V-B, VI-B of the Periodic Table; (II) alloys of at least two metals of (I) and (III) alloys and compounds of at least one metal of (I) with other metals which form a structurally coherent deposit of metals of (I).

9. The process of claim 8, wherein said pressure being less than one mm Hg.

10. The process of claim 9, wherein the temperature at which said melt is maintained being at least 10° C above its melting point.

11. The process as defined by claim 8, wherein said cations are of the group consisting of titanium, niobium, tungsten, chromium, hafnium, molybdenum, tantalum, vanadium, and zirconium.

12. The process of claim 8, wherein said cations are of the group consisting of tantalum, niobium, and tungsten.

13. The process of claim 8, wherein said cations are of niobium.

14. The process of claim 8, wherein said cations are of the group consisting of niobium, tungsten, chromium, hafnium, molybdenum, tantalum, vanadium, and zirconium.

15. The process of claim 8, wherein the temperature at which said melt is maintained being less than 750° C.

* * * * *